US009220662B2

(12) United States Patent
Amitai

(10) Patent No.: US 9,220,662 B2
(45) Date of Patent: Dec. 29, 2015

(54) MOUTH-HOLDABLE BOTTLE HOLDER

(76) Inventor: Asaf Amitai, Gedera (IL)

( * ) Notice: Subject to any disclaimer, the term of this patent is extended or adjusted under 35 U.S.C. 154(b) by 0 days.

(21) Appl. No.: 13/993,401

(22) PCT Filed: Jan. 29, 2012

(86) PCT No.: PCT/IL2012/050028

§ 371 (c)(1),
(2), (4) Date: Jun. 12, 2013

(87) PCT Pub. No.: WO2012/104849

PCT Pub. Date: Aug. 9, 2012

(65) Prior Publication Data

US 2013/0264437 A1 Oct. 10, 2013

Related U.S. Application Data

(60) Provisional application No. 61/437,810, filed on Jan. 31, 2011, provisional application No. 61/531,213, filed on Sep. 6, 2011.

(51) Int. Cl.
*A47D 15/00* (2006.01)
*A61J 9/06* (2006.01)

(52) U.S. Cl.
CPC . *A61J 9/06* (2013.01); *A61J 1/1418* (2015.05); *A61J 9/063* (2015.05); *A61J 9/0623* (2015.05); *A61J 9/0638* (2015.05); *A61J 9/0676* (2015.05); *A61J 2009/0623* (2013.01); *A61J 2009/0638* (2013.01); *A61J 2009/0676* (2013.01)

(58) Field of Classification Search
CPC ..... A61J 9/06; A61J 2009/0623; A61J 2009/0638; A61J 2009/0676; A61J 1/1418; A61J 9/063; A61J 9/0676; A61J 9/0638
USPC ..... 248/102–107, 313, 316.7, 312, 312.1; D24/199
See application file for complete search history.

(56) References Cited

U.S. PATENT DOCUMENTS

| | | | | | |
|---|---|---|---|---|---|
| 2,638,296 | A | | 5/1953 | Battle | |
| 2,803,417 | A | * | 8/1957 | Gruber | 248/103 |
| 3,289,986 | A | * | 12/1966 | Martin | 248/103 |
| D284,220 | S | * | 6/1986 | Pote | D24/199 |
| 4,723,801 | A | | 2/1988 | Musumeci et al. | |
| D309,018 | S | * | 7/1990 | Leach | D24/199 |
| 5,013,321 | A | * | 5/1991 | MacVane | 606/234 |
| 5,042,758 | A | * | 8/1991 | Roy et al. | 248/104 |
| 5,702,039 | A | * | 12/1997 | Olaiz | 224/409 |
| 6,938,861 | B1 | * | 9/2005 | Ballard et al. | 248/104 |
| 6,971,612 | B1 | * | 12/2005 | Wilson-Lowery | 248/104 |
| D573,662 | S | * | 7/2008 | Behn et al. | D21/398 |
| D607,115 | S | * | 12/2009 | Bellamy-Noseworthy et al. | D24/199 |
| 2001/0002011 | A1 | | 5/2001 | Tebeau | |
| 2005/0275229 | A1 | | 12/2005 | Cvijic | |
| 2007/0012822 | A1 | * | 1/2007 | Bellamy-Noseworthy et al. | 248/104 |
| 2007/0151568 | A1 | | 7/2007 | Maurello | |

FOREIGN PATENT DOCUMENTS

| | | |
|---|---|---|
| GB | 2368832 | 5/2002 |

* cited by examiner

*Primary Examiner* — Gwendolyn Baxter
(74) *Attorney, Agent, or Firm* — Tutunjian & Bitetto, P.C.

(57) ABSTRACT

A mouth-holdable bottle holder comprising: an intermediate portion having, at a side adjacent a leading end thereof, a mouth engagement portion; wherein the intermediate portion having, at a second side adjacent a second leading end thereof, a bottle engagement portion; and wherein the bottle engagement portion being adapted in size and shape to engage a bottle.

13 Claims, 6 Drawing Sheets

MOUTH-HOLDABLE BOTTLE HOLDER

CROSS-REFERENCE TO RELATED APPLICATIONS

This application claims the benefit of U.S. Provisional Application No. 61/437,810 filed Jan. 31, 2011 and U.S. Provisional Application No. 61/531,213 filed Sep. 6, 2011, both are hereby incorporated by reference in their entirety.

TECHNICAL FIELD

The present invention relates to bottle holders generally, and specifically to bottle holders that are mouth-holdable.

BACKGROUND

Various types of baby bottle holders are known in the art and in the patent literature.

SUMMARY

One exemplary embodiment of the disclosed subject matter is a mouth-holdable bottle holder comprising: an intermediate portion having, at a side adjacent a leading end thereof, a mouth engagement portion; wherein the intermediate portion having, at a second side adjacent a second leading end thereof, a bottle engagement portion; and wherein the bottle engagement portion being adapted in size and shape to engage a bottle.

Optionally, the mouth-holdable bottle holder is integrally formed as a single piece.

Optionally, the bottle engagement portion is adapted to be intermittently engaged with the bottle.

Optionally, the mouth-holdable bottle holder is permanently affixed to a bottle using the bottle engagement portion.

Optionally, the mouth-holdable bottle holder is permanently affixed to the bottle.

Optionally, the bottle is a baby bottle, wherein the baby bottle comprising a bottle teat; and wherein the bottle engagement portion being adapted in size and shape to engage baby bottles.

Optionally, the mouth engagement portion is adapted in size and shape to be held by a mouth of a human adult.

Optionally, the mouth engagement portion comprises a bite. The bite is configured to be held by a mouth of a human adult.

Optionally, the mouth engagement portion is formed of a flavored material.

Optionally, the intermediate portion is extendable so as to increase a distance between the leading ends thereof.

Optionally, the intermediate portion having an axis in between the leading ends. The bottle engagement portion is adapted to hold an engaged bottle perpendicularly to the axis.

Optionally, the bottle engagement portion comprising an integral claw shaped to hold the bottle.

Optionally, the integral claw is resilient, thus enabling insertion of the bottle to be held by the claw and to enable removal of the bottle.

Optionally, the integral claw comprises two tongs, and at least one of the two tongs is comprised by two elastic prongs.

Optionally, the bottle engagement portion comprising a claw having two tongs. At least one of the tongs being displaceable from the other thereby the bottle engagement portion being modifiable between a retaining position and a releasing position. The releasing position is characterized in the tongs being spaced apart to form an opening sufficient in size to allow the bottle to be inserted in between the tongs. The retaining position is characterized in the tongs clamping the bottle in sufficient force to retain the bottle.

Optionally, the bottle engagement portion comprises a claw having two jaws. At least one of the jaws is displaceable from the other thereby the bottle engagement portion being modifiable between a retaining position and a releasing position. The releasing position is characterized in the jaws being spaced apart to form a cavity sufficient in size to allow the bottle to be inserted in between the jaws. The retaining position is characterized in the jaws clamping the bottle in sufficient force to retain the bottle.

Optionally, the mouth-holdable bottle holder is a mouth-holdable baby bottle holder.

Another exemplary embodiment of the disclosed subject matter is a method for an adult to feed a baby using a mouth-holdable bottle holder being engaged with a baby bottle. The method comprises the adult feeding the baby using the baby bottle, and the adult supporting the baby bottle by holding the mouth-holdable bottle holder using a mouth of the adult.

Optionally, initially the adult supports the bottle by a hand of the adult. Then, the adult inserts a mouth engagement portion of the mouth-holdable bottle holder to the mouth of the adult, thereby allowing the adult to support the baby bottle without use of hands of the adult. Finally, the adult ceases to support the bottle by hand.

Optionally, the adult intermittently supports the baby bottle by holding the mouth-holdable bottle holder using the mouth of the hold and the adult intermittently supports the baby bottle by using a hand on the adult.

BRIEF DESCRIPTION OF THE DRAWINGS

The present disclosed subject matter will be understood and appreciated more fully from the following detailed description, taken in conjunction with the drawings in which.

DETAILED DESCRIPTION

Figure 1A:
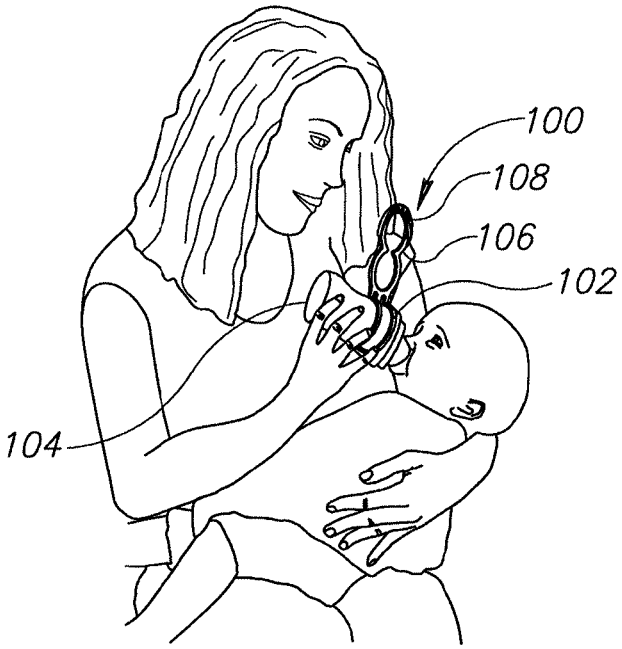
FIG. 1A-1B are illustrations of a mouth-holdable bottle holder constructed and operative in accordance with some embodiments of the disclosed subject matter in a typical use context.
Figure 1B:
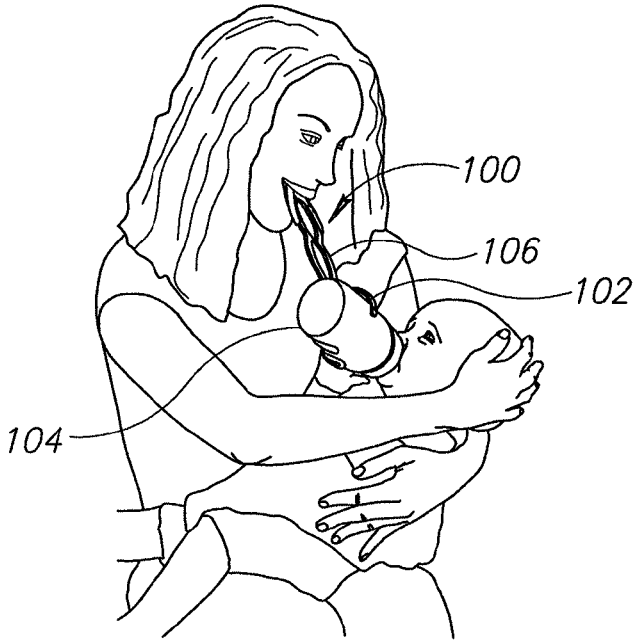

Reference is now made to FIG. 1A-1B showing illustrations of a mouth-holdable bottle holder constructed and operative in accordance with some embodiments of the disclosed subject matter in a typical use context.

FIG. 1A shows an adult feeding a baby using a baby bottle 104, where the baby is fed a bottle teat of the baby bottle 104. In the present disclosure "an adult" is a non-infant that takes the role of feeding the baby. It will be noted that in some cases, the adult may be a minor, a child, a parent of the baby, a babysitter, or the like.

FIG. 1B shows the adult feeding the baby without supporting the baby bottle 104 using the adult's hands. The adult utilizes a mouth-holdable baby bottle holder 100 that includes a baby bottle engagement portion 102, which engages the baby bottle 104, an intermediate portion 106, which extends outwardly from the baby bottle engagement portion 102 and a mouth engagement portion 108.

In some exemplary embodiments, the adult may switch between the modes of FIG. 1A and 1B, inserting the mouth engagement portion 108 in the adult's mouth and thus enabling supporting the baby bottle 104 without the use of hands.

Reference is now made to FIGS. 2A-2E showing various views of a mouth-holdable bottle holder, in accordance with the disclosed subject matter.

Turning now to FIGS. 2A-2E, there is seen a mouth-holdable baby bottle holder 300 including a baby bottle engagement portion 308 engaging a baby bottle 309, having an axis of symmetry 380; an intermediate portion 305, preferably extending away from the baby bottle engagement portion 308 in a direction angled with respect to the axis of symmetry 380 of the bottle 309 held thereby and a mouth engagement portion 330 at an end of the intermediate portion 305.

The mouth-holdable baby bottle holder in accordance with the disclosed subject matter can be made in any suitable configuration, of any suitable material or materials and by any suitable manufacturing technique. FIGS. 2A-2E, 3-9, 10A-10C show some examples of such configurations, it being understood that these examples are not limiting.

In some exemplary embodiments, the mouth-holdable baby bottle holder is integrally formed as one piece of a suitable material, which preferably is autoclavable or otherwise sterilizable, and preferably antibacterial matter, so as to be safely holdable in the mouth of the person feeding the baby. In some embodiments, the mouth-holdable baby bottle holder is formed of a one piece plastic material. Alternatively, the mouth-holdable baby bottle holder is formed of plural parts and/or different materials.

Figure 2A:
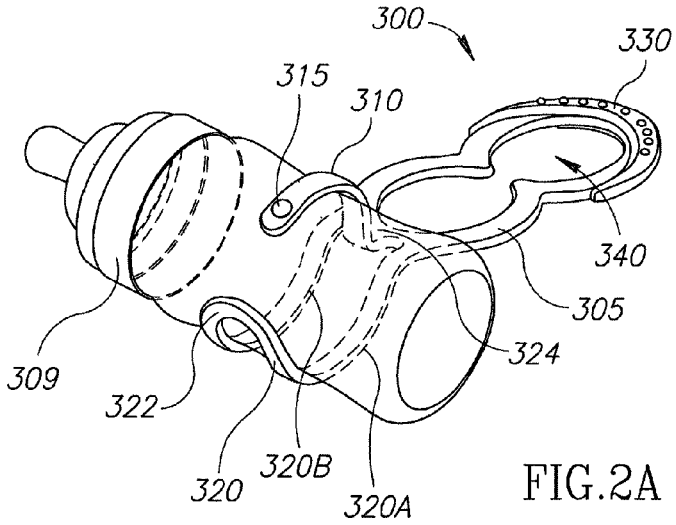
FIGS. 2A-2D are isometric views of a mouth-holdable bottle holder, in accordance with some embodiments of the disclosed subject matter.
Figure 2B:
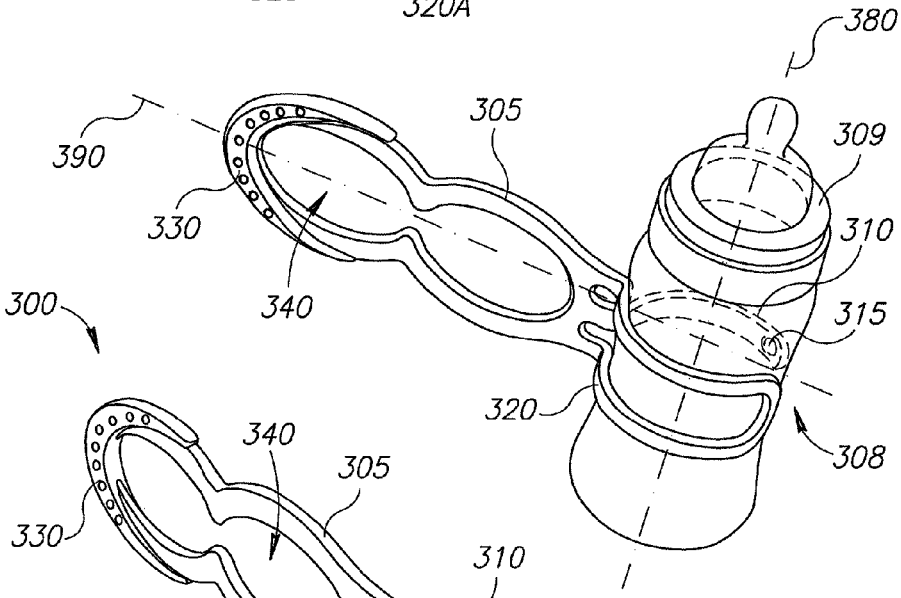
Figure 2C:
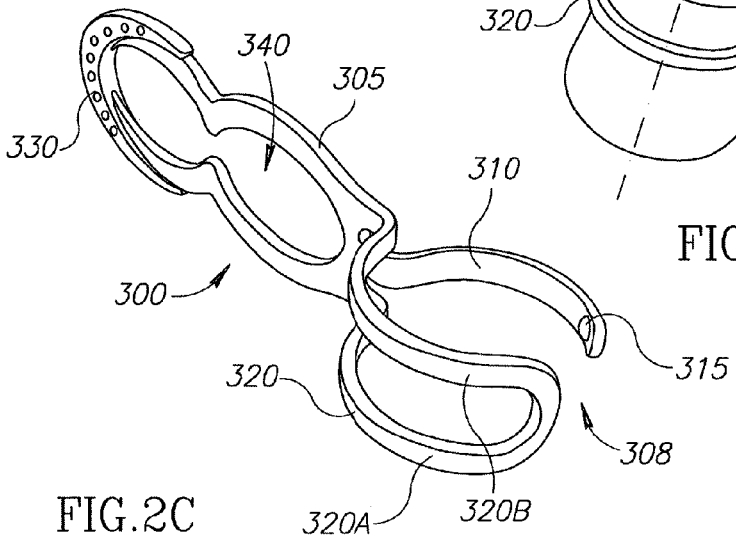
Figure 2D:
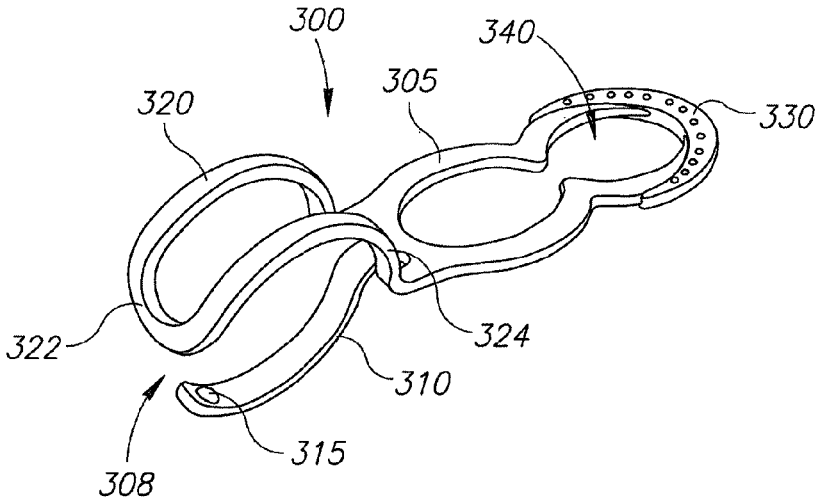
Figure 2E:
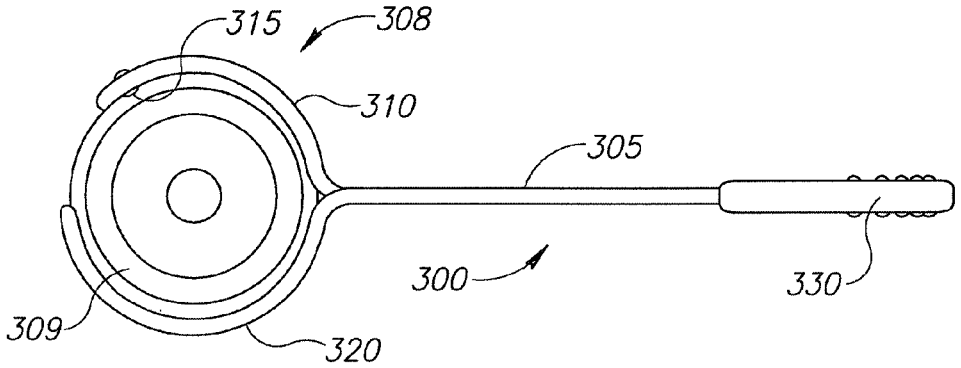
FIG. 2E is a top view of a mouth-holdable bottle holder, in accordance with some embodiments of the disclosed subject matter.
Figure 3:
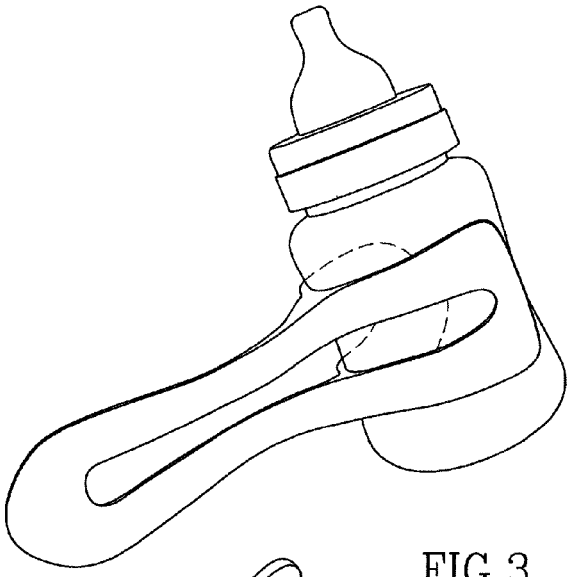
FIG. 3-7 and FIG. 9 are isometric views of alternative configurations of mouth-holdable bottle holders, in accordance with some embodiments of the disclosed subject matter.
Figure 4:
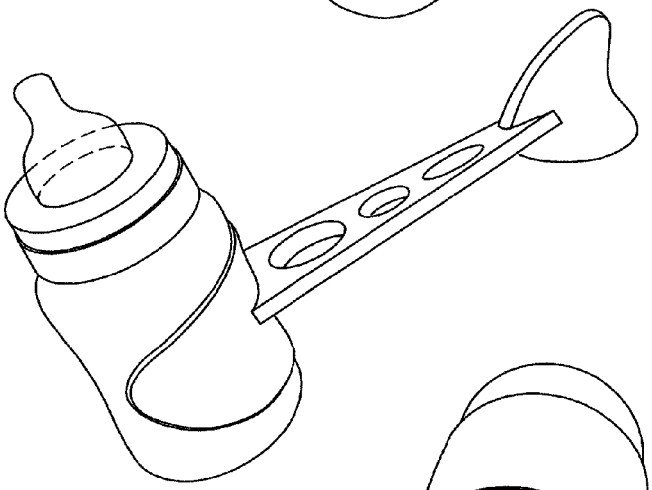

In the illustrated embodiment of FIG. 2A, the baby bottle engagement portion 308 is formed of a somewhat resilient plastic and has a relatively high friction conditioned bottle engaging surface for good friction engagement with a baby bottle. The resiliency preferably allows the baby bottle engagement portion 308 to be suitable for use with baby bottles of various cross sectional diameters and to be readily attached and disengaged therefrom. Additionally or alternatively, a baby bottle with a baby bottle specific mouth-holdable baby bottle holder may be provided. In such a case, the mouth-holdable baby bottle holder may be integrally formed with the baby bottle.

The intermediate portion 305 may be of any suitable configuration that is comfortable for the user. Examples of various configurations are shown in FIGS. 2A-2E, 3-9, and 10A-10C, it being appreciated that other configurations may also be used.

The intermediate portion 305 is preferably relatively rigid, so as not to readily bend under the weight of a full baby bottle. It may extend generally perpendicularly to axis 380, substantially in the axis 390, or at any other suitable angle which is convenient to the user. The angle may be adjustable or fixed. In some exemplary embodiments, the intermediate portion 305 may extend axially or non-axially.

The mouth engagement portion 330 may be of any suitable configuration that is comfortable for the user. Examples of various configurations are shown in FIGS. 2A-2E, 3-9, and 10A-10C, it being appreciated that other configurations may also be used.

In some exemplary embodiments, at least the mouth engagement portion 330 is formed from and/or covered by an elastic material so as to enable holding the mouth engagement portion 330 comfortably by a human jaw and/or teeth. One non-limiting example of an elastic material may be rubber, silicon, or the like. The material may also have additional characteristics, such a texture, flavor, or the like, that would render engaging the mouth engagement portion 330 relatively comfortable. In some exemplary embodiments, the mouth engagement portion 330 may be shaped similarly to a mouthguard or a bite so as ease a user to setting his teeth in the mouth engagement portion 330 to hold the apparatus. Optionally, the bite may be held by a person's gum, lip, mouth, or the like.

In some exemplary embodiments, the intermediate portion 305 together with the mount engagement portion 330 may be adapted in size, length, weight and/or shape to the mouth-holdable baby bottle holder 300 being connected to a bottle having weight of at most few dozen grams (e.g., 50 g, 60 g, 100 g, or the like) when empty, without causing the bottle to tip over. As the mouth-holdable baby bottle holder 300 may be connected to an empty bottle, when the bottle is placed on a surface, a moment force may be applied on the bottle. The magnitude of the force may depend on the size, length, weight and/or shape of the mouth-holdable baby bottle holder 300. The size, length, weight and/or shape may be adapted so as to induce a force that would not be sufficient to cause the bottle to tip over. In some exemplary embodiments, for bottles of size of about 25 cm, the mouth-holdable baby bottle holder 200 may have length of about 20 cm, width of about 5 cm, and weight of about 20 g.

The baby bottle engagement portion 308 may be formed using at least a first clamping jaw 310 and a second clamping jaw 320. An angle, shape and size of the opening between the two clamping jaws 310 and 320 may be adapted to sizes and shapes of baby bottles that can be engaged by the baby bottle engagement portion.

In some exemplary embodiments, clamping jaws 310 and 320 may be formed of a sufficiently flexible material, so as to enable insertion of the baby bottle 309 in the opening between the two clamping jaws 310 and 320 without substantially adjusting the opening.

Alternatively, clamping jaws 310, 320 may be adjustable, such as to form tongs capable of holding the baby bottle. The opening between the tongs may be adjustable. Optionally, the tongs may be configured so as to produce clamping force in between the clamping jaws 310 and 320. As a non-limiting example, a spring may be used to produce the desired force. Alternatively, the clamping jaws 310, 320 may be interconnected using an adjustable hinge, such that the opening may be modified and locked at different angles.

In some exemplary embodiments, a clamping jaw, such as 320, may be formed of two or more prongs 320A and 320B. As each prong may be elastic, each may be subject to different distortions, so as to be adapted to a non-cylinder shape having different cross sectional diameters in different portions thereof. In some exemplary embodiments, a distance between the two or more prongs 320A and 320B may be substantially fixed by affixing both ends thereof on joint elements (322, 324).

In some exemplary embodiments, a friction engagement member 315 may be placed on a clamping jaw, such as 310. The friction engagement member 315 may be configured, using suitable size, shape, and material, to produce sufficient friction with a baby bottle, thus providing sufficient grip of the baby bottle.

Aperture 340 may be formed in the intermediate portion. In some exemplary embodiments, the aperture 340 may be utilized for hanging the apparatus. Additionally or alternatively, the aperture 340 may be adapted in size and shape to a human hand so as to enable comfort holding by a hand of a grownup.

Figure 5:
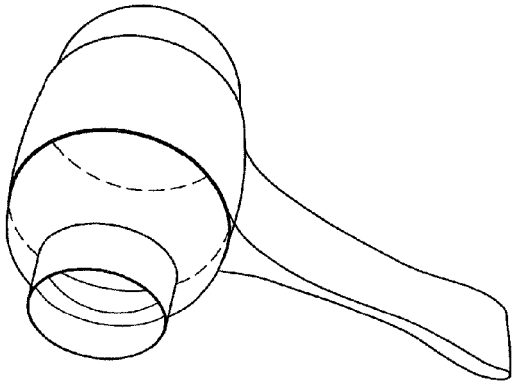
Figure 6:
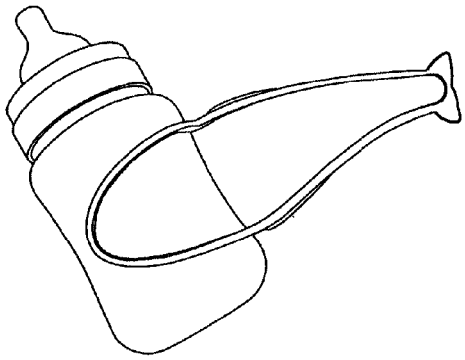
Figure 7:
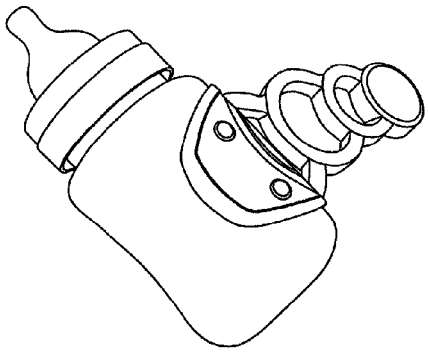

Reference is now made to FIG. 5 showing a mouth-holdable baby bottle holder that is permanently affixed to the baby bottle. In some exemplary embodiments, the baby bottle may be produced so as to integrally include a mouth-holdable baby bottle holder. The baby-bottle may be permanently affixed to a bottle engagement portion, which may be integrally formed in the baby bottle. The bottle engagement portion may be positioned on one side of an intermediate portion, whereas on the opposite side a mouth engagement portion is positioned.

Figure 8:
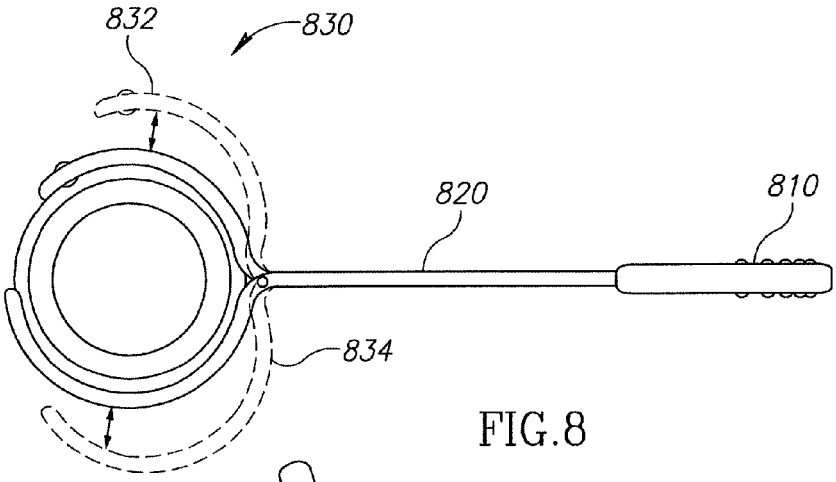
FIG. 8 is a top view of a mouth-holdable bottle holder having an adjustable claw, in accordance with some embodiments of the disclosed subject matter.
Figure 9:
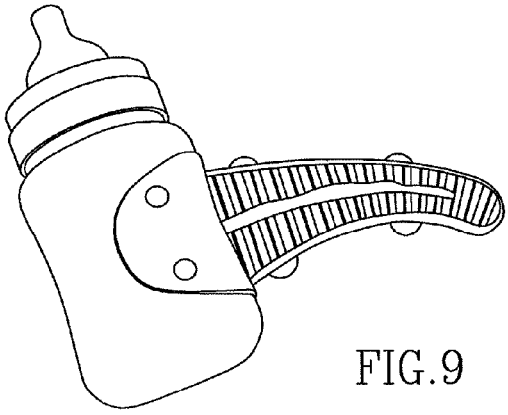

Reference is now made to FIG. 8 showing a mouth-holdable baby bottle holder having an adjustable claw, in accordance with some embodiments of the disclosed subject matter. A mouth-holdable baby bottle holder comprises of a mouth holdable portion 810, an intermediate portion 820 and a baby bottle engagement portion 830. The baby bottle engagement portion 830 comprises two tongs (832, 834). The tongs may be displaceable with respect to one another, enabling to modify the opening thereinbetween. By enlarging the opening, a baby bottle may be inserted therebetween. Alternatively, by decreasing the size of the opening, tongs 832, 834 may induce a clamping force on the baby bottle and hold the baby bottle in place. In some exemplary embodiments, a hinge located in the base of the intermediate portion 820 may be used to enable changing the position of the tongs. Additionally or alternatively, the tongs location may be locked into place, such as by locking the hinge. Optionally, a spring may be utilized to provide a clamping force to the tongs.

Figure 10A:
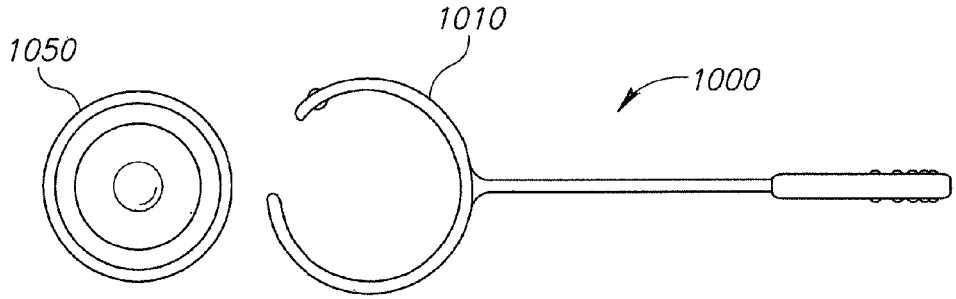
FIGS. 10A-10C show top views a moth-holdable bottle holder having an integral and resilient claw, in accordance with some embodiments of the disclosed subject matter.
Figure 10B:
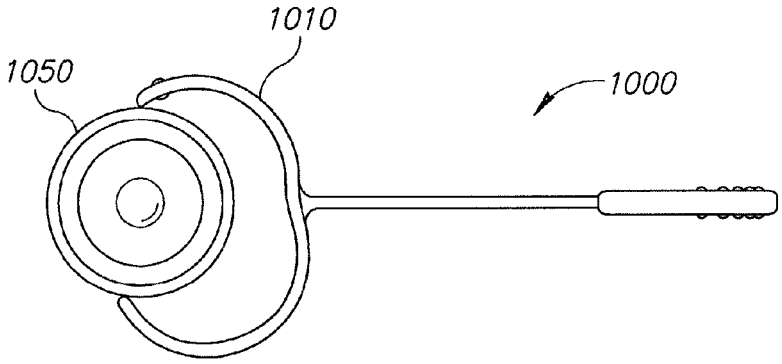
Figure 10C:
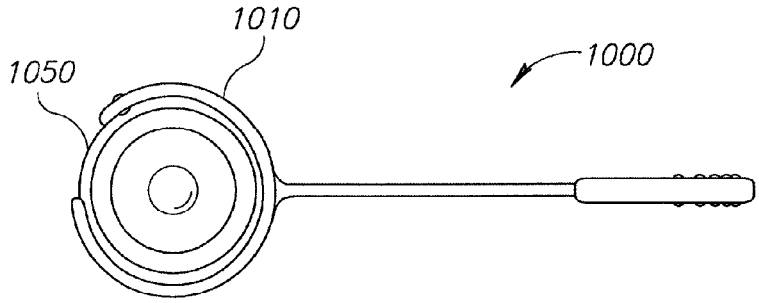

Reference is now made to FIGS. 10A-10C showing top views of a mouth-holdable bottle holder 1000 having an integral and resilient claw, in accordance with some embodiments of the disclosed subject matter. A bottle 1050, preferably a baby bottle having a teat, is inserted to the bottle engagement portion 1010 ((FIG. 10A). The bottle engagement portion 1010 is configured as an integral resilient claw. Upon insertion of the bottle 1050 to the bottle engagement portion 1010 using sufficient force, the resilient tongs of the claw are pressed by the bottle 1050 thereby increasing the space thereinbetween to allow insertion of the bottle engagement portion 1010 (FIG. 10B). After the bottle is inserted 1050 and in view of its substantial cylinder shape, the resilient tongs of the claw fall back into place, resiliently holding the bottle in place (FIG. 10C). Other configurations that are based on a resilient bottle engagement portion may be utilized in accordance with the disclosed subject matter.

In some exemplary embodiments, a baby may be fed using a baby bottle. An adult feeding the baby may use a mouth-holdable bottle holder in accordance with the disclosed subject matter, to support the bottle so as to allow the baby to feed without the use of the adult's hands. In some exemplary embodiments, the adult may initially hold or otherwise support the bottle using his hand. Thereafter, such as when the adult needs his hand to be used for other operation (e.g., cleaning the baby's face, arranging the adult's hair, picking up a toy, or the like), the adult may engage the mouth engagement portion and support the baby bottle using his mouth. Thereby, the adult's hand may be freed from supporting the baby bottle, and the adult may thus support the baby bottle without use of the adult's hands. The adult may intermittently switch between supporting the baby bottle using his hand or other body parts and supporting the baby bottle using the mouth-holdable baby bottle holder using the adult's mouth.

It will be appreciated by persons skilled in the art that the present invention is not limited by what has been particularly shown and described hereinabove. Rather the scope of the invention also includes variations and modifications that would occur to persons skilled in the art upon reading the foregoing description and which are not in the prior art.

The invention claimed is:

1. A mouth-holdable bottle holder comprising:

a mouth engagement portion at one end;

an intermediate portion having one end connected to the mouth engagement portion, a second opposing end and an axis extending from said mouth engagement portion to said second opposing end; and a bottle engagement portion disposed at the second opposite end of the intermediate portion and being adapted in size and shape to engage a bottle;

wherein said bottle engagement portion is configured to hold the bottle in an operable position at an angle substantially perpendicular to the axis.

2. The mouth-holdable bottle holder of claim 1, wherein the mouth engagement portion, the intermediate portion and the bottle engagement portion are integrally formed as a single piece.

3. The mouth-holdable bottle holder of claim 1, wherein said bottle engagement portion is adapted to be releasably engaged with the bottle.

4. The mouth-holdable bottle holder of claim 1, wherein the mouth-holdable bottle holder is permanently affixed to the bottle using the bottle engagement portion.

5. The mouth-holdable bottle holder of claim 1, wherein the bottle is a baby bottle having a bottle teat; and wherein said bottle engagement portion is adapted in size and shape to engage the baby bottles.

6. The mouth-holdable bottle holder of claim 1, wherein said mouth engagement portion is adapted in size and shape to be held by a mouth of a human adult.

7. The mouth-holdable bottle holder of claim 1, wherein said mouth engagement portion further comprises a bite portion being configured to be held by a mouth of a human adult.

8. The mouth-holdable bottle holder of claim 1, wherein said mouth engagement portion is formed of a flavored material.

9. The mouth-holdable bottle holder of claim 1, wherein said intermediate portion is extendable so as to increase a distance between said leading ends thereof along said axis.

10. The mouth-holdable bottle holder of claim 1, wherein said bottle engagement portion includes an integral claw shape to hold the bottle.

11. The mouth-holdable bottle holder of claim 10, wherein said integral claw is resilient to enable insertion of the bottle to be held by said claw and to enable removal of the bottle.

12. The mouth-holdable bottle holder of claim 10, wherein said integral claw includes two tongs, and wherein at least one of said two tongs includes two elastic prongs.

13. The mouth-holdable bottle holder of claim 1, wherein said bottle engagement portion includes a claw having two tongs, at least one of said tongs being displaceable from the other such that said bottle engagement portion is modifiable between a retaining position and a releasing position;

the releasing position being characterized by said tongs being spaced apart to form an opening sufficient in size to allow the bottle to be inserted in between the tongs; and the retaining position being characterized by said tongs clamping the bottle with sufficient force to retain the bottle.

* * * * *